United States Patent [19]

Judd

[11] Patent Number: 4,867,448

[45] Date of Patent: Sep. 19, 1989

[54] BASEBALL BATTING PRACTICE DEVICE

[76] Inventor: James A. Judd, 253 Braeshire Dr., Manchester, Mo. 63021

[21] Appl. No.: 128,875

[22] Filed: Dec. 4, 1987

[51] Int. Cl.[4] ..... A63B 69/40

[52] U.S. Cl. ..... 273/26 E; 273/29 A; 273/58 C; 272/78

[58] Field of Search ..... 273/29 R, 29 A, 26 E, 273/26 R, 413, 58 C; 272/76, 77, 78

[56] References Cited

U.S. PATENT DOCUMENTS

| | | | |
|---|---|---|---|
| 1,554,409 | 9/1925 | Coffee | 273/26 E |
| 2,247,072 | 6/1941 | Stow | 273/29 A |
| 4,088,316 | 5/1978 | Szafianski | 273/58 C |
| 4,138,107 | 2/1979 | Janis | 273/29 A |

FOREIGN PATENT DOCUMENTS

| | | | |
|---|---|---|---|
| 2113601 | 9/1972 | Fed. Rep. of Germany | 273/58 C |
| 1325472 | 3/1963 | France | 272/78 |

*Primary Examiner*—Edward M. Coven
*Assistant Examiner*—T. Brown

[57] ABSTRACT

A device to allow an object to be hit and which will return the object to its original position. The device is comprised of an object for hitting with an opening through the center allowing attachment to an elastic member suspended at the upper end to a solid object and retained in a given position at the lower end by any suitably weighted mechanism or solid object. This device will allow one to hit the object for hitting with the object for hitting being continously returned to the original hitting position.

1 Claim, 1 Drawing Sheet

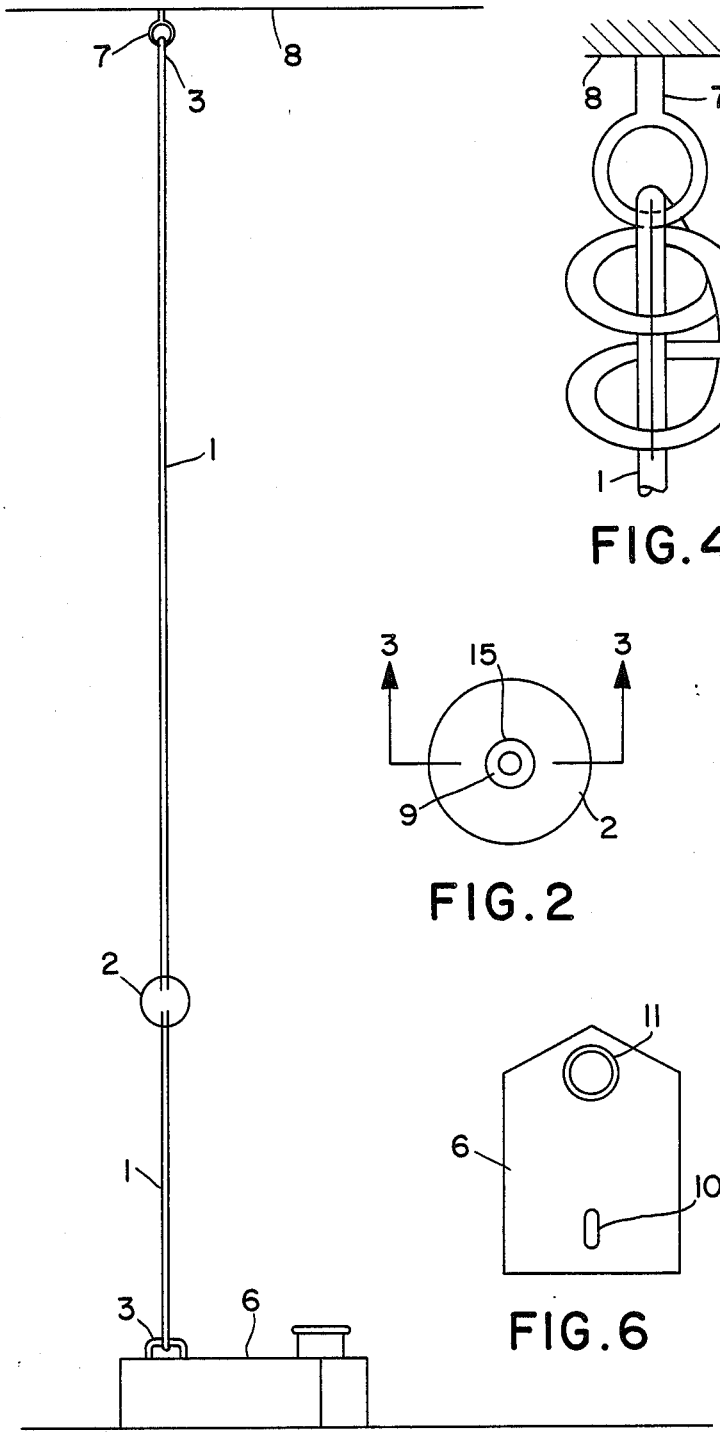
FIG. 1
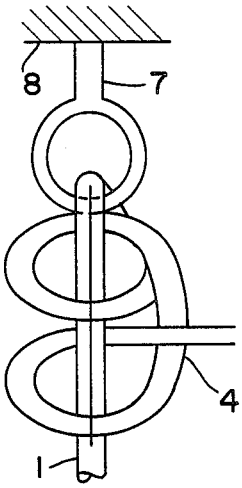
FIG. 4
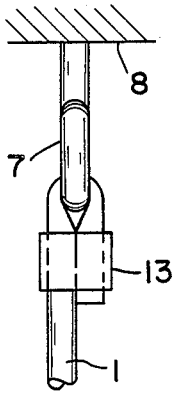
FIG. 5
FIG. 2
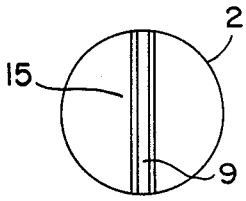
FIG. 3
FIG. 6
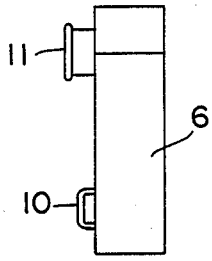
FIG. 7
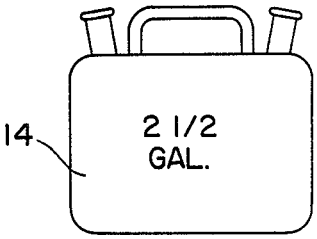
FIG. 8

BASEBALL BATTING PRACTICE DEVICE

BACKGROUND OF THE INVENTION

1. Field of the Invention

The invention relates generally to an inexpensive device for maintaining the position of an object for hitting, allowing one to hit the object, for which the device will return the object to the original position for continuous hitting practice, allowing the individual to concentrate on the application of hitting technique without having to worry about the replacement of the object for hitting.

2. Description of the Prior Art

Hitting practice devices currently in use utilize either a ball attached to a long rubber band type material which always requires retrieval of the ball for replacement on the stand for continuous hitting: or hanging devices which are attached to a solid overhang such as a rafter and require a net or mat to keep the ball from recoiling to the ceiling each time it is hit. This second type is also restrictive for outdoor use due to the restrictive nature of objects available for the placement of devices. Also there is currently nothing available to allow a novice hitter to practice swinging techniques at a larger object that doesn't misdirect the hitter's attention by causing them to focus on the contact with the smaller object rather than the technique of swinging at the object. It is the inventor's feeling that the novice could learn better techniques by just swinging hard without trying to hit an object that might be as small as a baseball.

SUMMARY OF THE INVENTION

The invention relates to a device which would allow an object that one desires to practice hitting to be suspended from a solid overhead object by an elastic member attached at the bottom to a relatively solid positioner thereby retaining the object for hitting on its same vertical axis after being struck as often times as is desired with a device for hitting, without necessitating the replacement of the object being hit. The object for hitting has an opening through the center which allows for attachment to the device. The device has sufficient elasticity to allow for the displacement of the object when the object is struck with any hitting device.

It is an object of the invention to provide an inexpensive device to allow an individual to practice hitting techniques without worrying about the replacement of the object for hitting.

BRIEF DESCRIPTION OF THE DRAWINGS

FIG. 1 is a plan view showing an embodiment of the Two-Tie Hitting Practice Rebounder.

FIG. 2 is an elevation view of the embodiment of the object for hitting.

FIG. 3 is a sectional view of the object for hitting, along section 3—3 of FIG. 2.

FIG. 4 is a view showing in greater detail, an embodiment of the termination means at either end of the elastic member.

FIG. 5 is a view showing another option of the termination means at either end of the elastic member.

FIG. 6 is an elevation view of the container made of a plastic type material for the attachment of the termination means on the lower end of the elastic member.

FIG. 7 is a side-view of the embodiment shown in FIG. 6.

FIG. 8 is a side-view of another embodiment of the container made of a plastic type material for the attachment of the termination means on the lower end of the elastic member.

DESCRIPTION OF THE PREFERRED EMBODIMENT

Referring to FIG. 1, an embodiment of the Two-Tie Hitting Practice Rebounder is shown attached to a solid overhanging object$_8$. In this embodiment, the Rebounder comprises the elastic member$_1$, which is attached at the upper end to the solid object$_8$ by means of an ordinary eye bolt$_7$ and by using any of many available methods for a termination means$_3$. Shown suspended on the vertical elastic member$_1$ is the object for hitting$_2$, which in this embodiment, takes the shape of a ball and has an opening$_9$ through the center for the attachment to the elastic member. It is the intention that this object for hitting$_2$ can take on other shapes to improve the desired training effect. The lower end of the elastic member can be attached in a similar termination means$_3$ as the upper end of the elastic member$_1$, except that the lower end is attached directly to the container$_6$ made of a plastic type material. The plastic material of which this container$_6$ is made is similar to the plastic materials that containers currently produced for the conveyance and storage of liquids such as gasoline are made. In this representation, the overhanging solid object$_8$ is shown as a rafter in the ceiling of a garage or basement, however this invention is made to be attached to any overhead object solid enough to retain the position of the object for hitting$_2$, such as a large tree limb or other suitable structure.

Referring to FIG. 2 an elevation view of the object for hitting$_2$ is shown and in this representation is shown with a sleeve$_{15}$ passing through the center, which, for durability, may be needed in certain materials used for the object for hitting$_2$, and which when used would have a similar inside diameter as the outside diameter of the elastic member$_1$ and forming the opening$_9$. When this protecting sleeve$_{15}$ is not needed then the object for hitting$_2$ would have an opening$_9$ through the center with a similar inside diameter as that of the outside diameter of the elastic member$_1$. The opening$_9$ in the object for hitting$_2$ is of a diameter which is similar to the outside diameter of the elastic member$_1$ so that the object for hitting$_2$ can be forcibly slid over the elastic member$_1$, and the object for hitting$_2$ will retain its relative horizontal positioning on the elastic member$_1$.

FIG. 3 is a sectional view along 3—3 of FIG. 2 which shows that the opening$_9$ in the sleeve$_{15}$ and the sleeve$_{15}$ go completely through the object for hitting$_2$, in order that the object for hitting$_2$ can be slid over the elastic member$_1$ with frictional resistance.

A close-up of an upper termination means$_3$ is shown in FIG. 4 attaching to a solid object$_8$ by means of an eye bolt$_7$ with a knot$_4$ securing the attachment. The knot$_4$ is made by merely tying the elastic member$_1$ through the opening in the eye bolt$_7$ and back around itself. For objects suitable for the direct attachment of the elastic member$_1$, such as a tree limb, a knot$_4$ such as that shown, could be used to attach the elastic member$_1$ directly.

FIG. 5 is showing another method for attaching the elastic member$_1$ to the eye bolt$_7$. In this embodiment the elastic member$_1$ is attached to the eye bolt$_7$ by means of any of a number of available clamps$_{13}$ which can secure the elastic member$_1$ to itself.

In FIG. 6 an elevated view of the container$_6$ made of a plastic type material is shown. In this view the coverable opening$_{11}$ is shown with the cover in place. It is the intention that either water or sand could be placed in the plastic container$_6$ in order to give enough weight to the plastic container$_6$ to keep the lower end of the elastic member$_1$ in the same relative position. This plastic container is adequately sized at a volume at or about that of a 2.5 gallon container$_6$. The closed hook type handle$_{10}$ for the attachment of the elastic member$_1$ is also shown at the very forward end of the container$_6$ made in the shape of a baseball home plate.

In FIG. 7 a side-view of the container$_6$ made of a plastic type material is shown. In this view the shape of the closed hook type handle$_{10}$ for the attachment of the elastic member$_1$ can be seen. Also a view of the spouted opening$_{11}$ for the insertion of a free flowing type material can be seen.

In FIG. 8 a common plastic container$_{14}$ is shown as an alternative to the plastic container$_6$ shaped like a baseball home plate. The container$_6$ shaped like a baseball plate would be a specialty order item, whereas, the container$_{14}$ represented in this drawing is of the type made for gasoline storage and is commonly available and of sufficient durability. Any other suitably weighted object or attaching mechanism for retaining the lower end of the elastic member may be utilized.

I claim:

1. A device for the suspension and retention of an object for the purpose of hitting practice, comprised of a vertically extending a single elastic member having upper and lower ends, means for attaching said upper end to an upper support an object attached intermediate said ends of said elastic member, said lower end being attached to a hollow container made of a plastic material, to said container having a general shape of a conventional baseball game's home plate, with a coverable spouted opening for adding a free flowing weighted material in a quantity of from 2 to 5 gallons, and having a closed hook attached to said lower end of said termination means of the elastic member.

* * * * *